US005974691A

United States Patent [19]

Marchal et al.

[11] Patent Number: 5,974,691

[45] Date of Patent: Nov. 2, 1999

[54] METHOD FOR DEWATERING A SHEET OF CELLULOSE MATERIAL USING HOT AIR CAUSED TO FLOW THERETHROUGH BY MEANS OF A HIGH VACUUM, DEVICE THEREFOR AND RESULTING MATERIAL

[75] Inventors: Paul Marchal, Leimbach; Claude Lesas, Colmar; Jean Lehervet, Colmar; Emmanuelle Kientz, Colmar, all of France

[73] Assignee: James River, France

[21] Appl. No.: 08/913,627

[22] PCT Filed: Mar. 20, 1996

[86] PCT No.: PCT/FR96/00414

§ 371 Date: Sep. 19, 1997

§ 102(e) Date: Sep. 19, 1997

[87] PCT Pub. No.: WO96/29467

PCT Pub. Date: Sep. 26, 1996

[30] Foreign Application Priority Data

Mar. 20, 1995 [FR] France ..... 95 03220

[51] Int. Cl.[6] ..... D21F 5/00; F26B 11/06

[52] U.S. Cl. ..... 34/456; 34/122

[58] Field of Search ..... 34/446, 452, 456, 34/115, 122, 125

[56] References Cited

U.S. PATENT DOCUMENTS

| | | | |
|---|---|---|---|
| 3,432,936 | 3/1969 | Cole et al. . | |
| 3,447,247 | 6/1969 | Daane | 34/122 |
| 3,913,241 | 10/1975 | Chaikin et al. | 34/122 |
| 4,146,361 | 3/1979 | Cirrito . | |
| 4,662,398 | 5/1987 | Wywailowski et al. | 34/122 X |
| 5,438,765 | 8/1995 | Tyrmi et al. | 34/456 |

FOREIGN PATENT DOCUMENTS 2122322 1/1984 United Kingdom .

OTHER PUBLICATIONS

R.H. Crotogino, "Weiterentwicklung der Trockenpartie; Prallström und Durchlufttrocknung," Das Papier, (1975), pp. 127–133.

*Primary Examiner*—Henry Bennett
*Assistant Examiner*—Steve Gravini
*Attorney, Agent, or Firm*—Finnegan, Henderson, Farabow, Garrett & Dunner, L.L.P.

[57] ABSTRACT

A method for drying a cellulose web, in particular a moist paper web evincing a dry-state specific surface weight of between 10 and 80 g/m$^2$ and initially a solids content between 8 and 30% approximately, and including supporting the web on a permeable conveying fabric and having a high-speed flow of hot air pass through the web, is characterized in that the flow of air is generated by a relative negative pressure of 100 to 500 mbars generated underneath the fabric.

21 Claims, 9 Drawing Sheets

METHOD FOR DEWATERING A SHEET OF CELLULOSE MATERIAL USING HOT AIR CAUSED TO FLOW THERETHROUGH BY MEANS OF A HIGH VACUUM, DEVICE THEREFOR AND RESULTING MATERIAL

The invention concerns dewatering, i.e., dehydrating, a cellulose sheet or web, in particular in the field of manufacturing wadding or tissue paper, namely an absorbent paper of comparatively low specific surface weight and generally in creped form and used for household or sanitary purposes: toilet paper, paper towels, etc. In particular, the object of the invention is a dewatering method for a paper web implemented after the forming stage but before final desiccation.

As regards conventional paper manufacture and following web formation and first draining, dewatering is carried out by mechanical pressing before the web is dried. In the case of wadding or tissue paper manufacture, one known means consists in pressing and bonding by an appropriate adhesive the still moist web against a cylinder, which is commonly called a Yankee cylinder, and which is fitted with a drying hood.

A procedure for dewatering and drying by blowing hot air through the web which lays on a permeable fabric, which itself is carried along on a permeable support, is known. The support consists of a porous wall of a rotating drum. A hot-air flow at a pressure slightly higher than atmospheric is made to pass from the drum inside toward the web surface which it then passes through. An enclosure open on its side facing the web and at a shallow vacuum collects the moisture-saturated air which then is evacuated by a suction fan. According to U.S. Pat. No. 3,303,576, a web initially at 20% solids content and having a specific fiber surface weight of 20 g/m$^2$ is raised to a solids content of 50% using a 250° C. hot-air flow at a rate of approximately 2–3 Nm$^3$/sec/m$^2$ (30–45 lbs/min/ft$^2$) and at a pressure in the supply enclosure of about 5 to 15 cm water above ambient pressure. The solids content is raised to 80% in a second, through-air dryer. According to the patent and using this apparatus, uniform drying is achieved over the full width of the web without damaging the fibers. The effectiveness of such a system is due in part to the contact evaporation between the moist fibers entering the dryer and the drying air, and further to the air flow dragging the liquid water. Consequently, this kind of drying equipment with one or more cylinders is called a through-air dryer.

Whereas evaporative drying depends on the air volume and on the dry bulb and wet bulb temperatures of this air, the dragging of liquid particles depends on the air speed. U.S. Pat. No. 3,447,247 proposes drying equipment wherein the drying air is projected at high speed onto the web in the form of a plurality of high speed jets of small diameters. As a result, the air, instead of passing through the fiber material by following the zones of least resistance as will be the case if the pressure difference is low, is forced through the web over its full surface. More uniform drying is thus achieved. Moreover, the high jet speeds preclude sideways leaks and the demand for seals is less. Because of the efficacy of such apparatus, the other dryers and/or presses used in combination with the hot-air drying equipment may be eliminated. As regards the technology disclosed in this patent, the speed of the air jets so produced is 40 m/sec. Such a speed is substantially higher than that of conventional through-air dryers. However, it is also observed that the relative negative pressure at the suction box is kept at a low value, 30 cm of water or less.

Even though this kind of drying already was proposed many years ago, it appears not to have been adopted by industry, very likely because of the difficulty in controlling the high-energy air jets disturbing the structure of the paper web and the sealing of the system.

The invention proposes dewatering by simultaneously dragging water in the liquid state and by evaporation caused by a large flow of hot air passing through the moist web moved on a permeable conveying fabric. The procedure of the invention is characterized in that the air flow passing through the web is generated by a deep relative negative pressure of 100 to 500 millibars created underneath the moving fabric and applied through a stationary surface at the same time that the hot air is guided onto the free web surface.

Using a comparatively deep relative negative pressure results in setting up an air flow through the porous structure of the web at a rate sufficient to drag, by viscosity, the free water at the surface of the fibers and to withdraw the water from the web in the form of aerosols. Accordingly, the use of hot air as a supply for the air flow passing through the web comprises a dual object:

heating, by heat exchange, the free water at the fibers' surface in order to lower the water's viscosity and consequently the surfactant is forced toward the fibers; as a result the rate of mechanically discharged water from the web is substantially increased relative to withdrawal means lacking air heating; and cause water evaporation by heat exchange with the moist fibers.

Relative to the designs of the prior art wherein jets of hot air are projected onto the web surface, the invention allows the use of apparatus to implement the method which is much simpler and more economical. Illustratively, the seals are minimized to peripheral seals, none being required in the vicinity of the paper web, which would entail placing the web between two protective wires. The air-guiding means fitted into the feed box spreads the flow as uniformly as possible over the web surface, whereas in the prior art the air jets were applied to small areas. In the case of the prior art, it is true, jet effectiveness is unaffected by any heterogeneity of fiber distribution in the web, but on the other hand their action is non-uniform over the full surface. Lastly, the vacuum allows raising potential dewatering of a given mass of air at the same enthalpy.

The method of the invention allows raising the solids content of the moist web leaving the forming stage by magnitudes of about 8 to 25% to levels between 20 and 75%. In the present description, solids content denotes the ratio of the weight of absolutely dry fibers to that of moist fibers.

The final solids content depends on the web's dwell time in the hot flow of traversing air. This dwell time may vary from 0.001 seconds to 0.3 seconds for particular values of traversing air flow and its temperatures.

For a given dwell time within the above limits, the final solids content also depends on the initial web solids content, the topology being passed through by the air, the rate of the traversing air and the magnitude of the vacuum, further on its dry bulb and wet bulb temperatures.

According to another feature of the invention, the dry air temperature is between 100° and 500° C.

In yet another feature of the invention, the air is moist and its wet bulb temperature is between 50 and 90° C.

In still another feature of the invention, the air circulates in a closed circuit, and after passing through the web, it shall, in sequence:

be collected in a return header at a relative negative pressure of 100 to 500 mbars;

be guided toward an air/water separator to eliminate the suspended water;

be compressed to a pressure slightly above ambient;

be heated to a temperature between 100 and 500° C.; and be made to pass through the web again.

In still another feature of the method of the invention, a portion of the compressed air is evacuated and a corresponding quantity is introduced into the circuit in order to maintain the dehydrating air at a humid temperature between 50 and 90° C.

In still another feature of the invention, the web is traversed by at least a second hot-air flow downstream of the first and of which the moist temperature is different, and preferably less. This fractionation in the machine direction of the traversing hot air flow llows optimizing the thermodynamic parameters of the air flow as a function of the web's solids content evolution. The amount of moisture in the air may be less, in particular when solids content exceeds 40%.

In still another feature of the invention, and as regards a manufacturing method for a paper web, the web solids content is increased following draining to the level approximately between 35 and approximately 75%, preferably between about 35 and about 50%, using the deep-vacuum dewatering system of the invention, whereupon the web shall be dried using a Yankee-type cylinder until a solids content of about 95% is achieved.

In the latter method, the mechanical web resting on a felt in convention apparatus is replaced by the dewatering of the invention while parameterizing the dewatering in such a manner that the same solids content is achieved. Thanks to this feature of the method of the invention, a paper web is made which offers higher bulk than in the conventional case while nevertheless preserving machine speed and, hence, capacity because the solids content of the web entering the Yankee cylinder is unchanged.

In another feature of the invention regarding papermaking apparatus, deep relative negative pressure is carried out, following draining, in the manner of the method of the invention until solids content between 35 and 75% approximately is reached, the conveying fabric in this case being an imprinting fabric. Thereafter, the web is dried on a Yankee cylinder.

The expression imprinting fabric denotes a conveying fabric comprising a weaving structure with high and low porosity zones arrayed in a specified geometry in such a manner as to impart a heterogeneous structure to the web having compacting zones differing by the very dewatering effect of the traversing air of the invention.

Following dehydration, the web solids content is selected to be between 35 and 75% depending on the desired qualities of bulk as well as of web strength. Surprisingly, it was found that in the case of making high-bulk paper using an imprinting fabric, in which procedure the web is impressed on the fabric, a large marking effect is achieved, whereby the web volume is increased in the most porous zones, very likely on account of the deep relative negative pressure underneath the fabric. Also, it has been observed surprisingly that the relative negative pressure does not negatively affect appearance or web formation, the web remaining intact whereas the a priori danger of bursting is high.

In still another feature of the invention and regarding papermaking apparatus the procedure is such that, following draining, dewatering is carried out at the deep relative negative pressure of the invention until a solids content between 20 and 45% approximately has been reached, the conveying fabric in this case being an imprinting fabric. Next, the web is dried on this same fabric using a conventional through-air dryer until a solids content of 50 to 90% approximately has been reached, and lastly a Yankee cylinder having a creping scraper is used until a solids content of about 95% is achieved.

In still another feature of the invention, following draining, the web solids content is raised by approximately 8 to 30% to a level approximately 20 to 45% using the dewatering method, the conveying fabric then being an impression fabric which is used to dry the paper by means of a through-air drying system until a solids content of approximately 95% is reached.

In still another feature of the invention, at least part of the air being supplied to the feed box is withdrawn from the through-air drying system.

In still another feature of the invention, at least part of the air supplying the feed box is withdrawn from the drying hoods of the Yankee cylinder dryer.

In still another feature of the invention regarding the manufacture of a paper web and using a dewatering system of the invention, metered quantities of steam are injected into the hot-air flow before it passes through the web, in particular in the first of the dewatering zones as seen in the direction of advance of the web when the dewatering method comprises several zones. This injection will be modulated in such a manner that the moisture level of the air will vary in the transverse direction of the web for the purpose of withdrawing different quantities of water across the web. In this manner, the web's moisture profile is precisely controlled following drying as well as the quality of the web.

Another object of the present invention is a device, i.e., apparatus allowing implementation of the method. The apparatus comprises at least one air-feed box having an air-intake conduit and a feed aperture facing the web, further means for heating the air inside the air-intake conduit, at least one return header for the air issuing from the feed box and located opposite the web and its support-and-conveyance fabric, and comprising at least one suction slit opposite the feed aperture of the feed box, and one means for keeping the box at a relative negative pressure of 100 to 500 mbars. In particular, the apparatus also comprises an air/water separator allowing circulation of the air using a compressor communicating with a heater.

In particular, the method of the invention allows implementing total-energy apparatus. Illustratively in this case, the compressor may be driven by a gas turbine assembly, the turbine exhaust gases being fed to a heat exchanger which heats the air flow from the compressor before it is introduced into the feed box. The compressors may be composed of several compression units and the assembly also may be constituted of several individual gas turbine units.

Another object of the invention is a paper web, in particular evincing high bulk and being made by the deep relative negative pressure dehydration method.

Other features and advantages of the method of the invention are elucidated in the following description of non-limiting, illustrative embodiments and in the attached drawings.

FIG. 10 shows a cross-section of a header according to one embodiment of the present invention.

Figure 1:
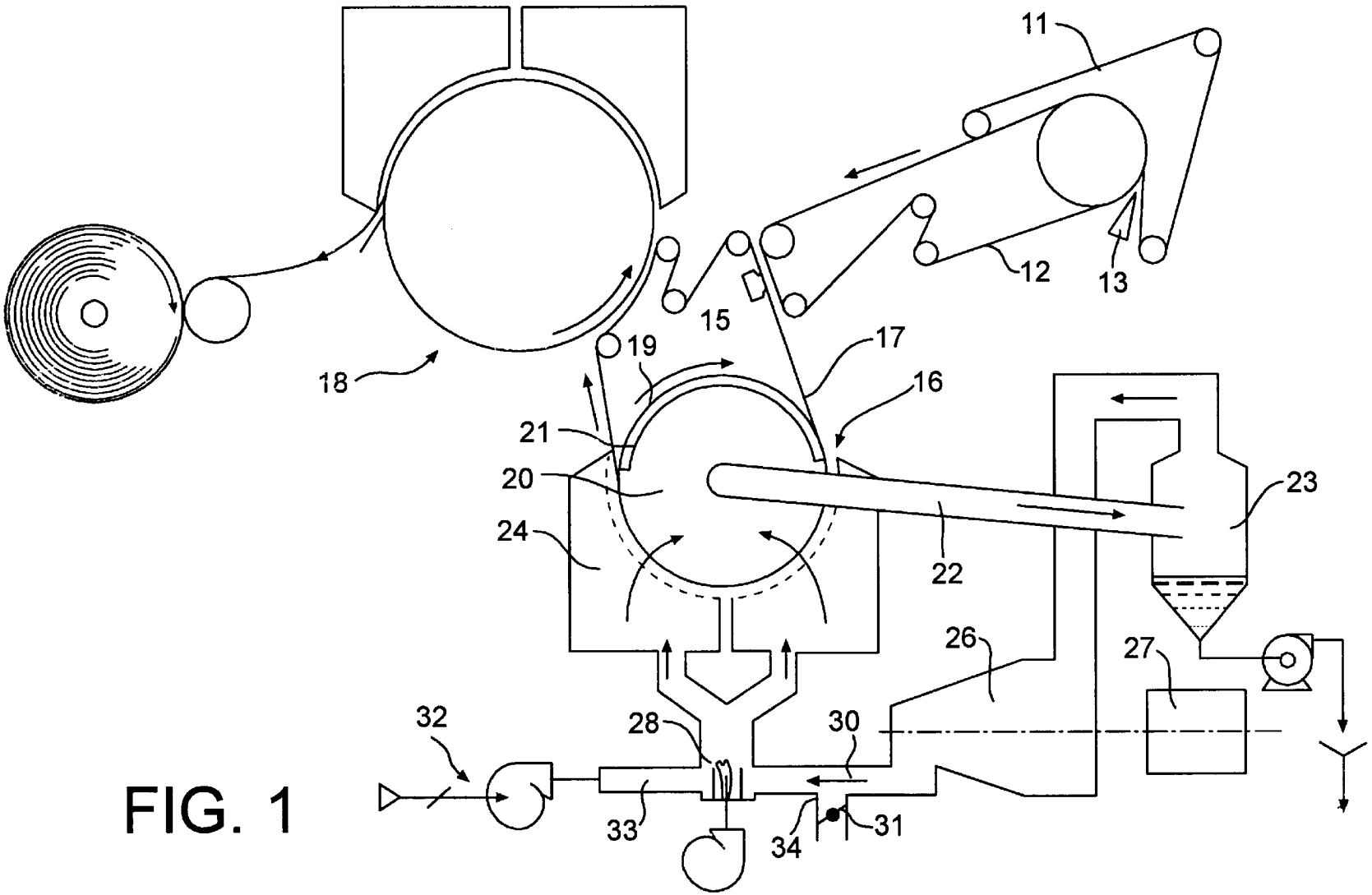
FIG. 1 shows apparatus of the invention in a first embodiment having a rotary suction cylinder.

The apparatus of the first embodiment of the invention for making absorbent paper having a specific surface weight of between 12 and 80 g/m$^2$ comprises, in the moist part, a web-forming stage which may be any kind known to the expert. In the example shown, the apparatus comprises a double wire 11 and 12 into a convergent space in which is injected a jet of pulp from a headbox 13. Following draining, whereby the web assumes a solids content of 8 to 25%, the web is moved toward a means 15 which ensures the web's transfer to a permeable conveying fabric 17. This fabric may be plain or an imprinting fabric depending on the implemented method of manufacture. The moist web is conveyed toward dewatering apparatus 16 from which the web exits rid of most of its water. At that stage, the web solids content is between 25 and 75%. Next, the fabric carries the web toward a drying cylinder 18 fitted with drying hoods and known as a Yankee cylinder to which the web is bonded using a suitable adhesive. During rotation, the web moves underneath the drying hoods and then is unbonded by means of a blade in order to crepe the web in a well known manner.

The dewatering device, i.e., apparatus 16, is composed of a rotary cylinder 19 mounted on a horizontal shaft. The cylinder surface is highly porous. An inside space 20 forms a return header and is bounded by a stationary mask 21 covering a cylinder sector and a sector complementary to the covered cylinder sector. The return header communicates through a conduit 22 with a source of relative negative pressure. The collecting box also communicates through its surface sector unobstructed by the mask 21 with one or more hot-air feed boxes 24 which are mounted outside the cylinder and which comprise apertures shaped like arcs of a circle that run parallel to its wall. These apertures are fitted with balancing means for the air flow such as fins or other equivalent means, in such a manner that the air flow moves at a constant speed over the full surface of the web. The boxes 24 are fed with hot air from a compressor 26 driven by, illustratively, an electric motor 27. The compressor may be any appropriate model, axial or centrifugal. The air from the compressor is heated to the desired temperature by a heating means, such as a burner 28 shown in the example. The conduit 30 connecting the compressor to the burner 28 comprises a tap 34 fitted with a valve 31 which controls the withdrawal of air from the circuit. An aperture 33 fitted with an air introducing means 32 which is operable in a variable manner, allows compensating for the air withdrawn through the aperture 34 and formation of a mixture with the residual compressed air from the conduit 30 before the residual compressed air is heated by the burner 28. The quantities of fresh and withdrawn air may be controlled by a suitable control means as a function of the relative humidity of the air inside the boxes 24. Also, a regulation circuit controls the fuel flow to the burner 28 as a function of the air temperature at the feed boxes 24. The conduit 22 is connected to a cyclone or other-model separator 23 in such a way that the air-suspended water drops may be removed from the circuit. This separator may be external to the dewatering apparatus as shown. However, the invention also covers the case of separating water from air near the air outlet, directly downstream of the moist paper web, for example using a baffle means fitted with gutters and arranged transversely to the flow in the intake zone of the enclosure 20. This latter embodiment is not shown in the drawings. The water collected in the separator is pumped to atmospheric pressure. The dehumidified air leaving the separator is guided to the intake of compressor 26 so as to be compressed again to a pressure slightly above atmospheric and is then used for dewatering.

The dewatering apparatus operates in the following manner. The moist web on fabric 17 is dragged around cylinder 19 and moves underneath the hot-air outlet nozzles of boxes 24. The deep relative negative pressure in the box is generated by the suction of compressor 26 and regulated to a level between 100 and 500 millibars and then forces the air flow from the boxes to pass through the web at a high speed. Preferably, the speed is between 5 and 50 m/sec. The water is withdrawn from the web in part by evaporation and in part in the form of aerosols. The separator is placed some distance from the box 20, this distance being selected in such a manner that the water suspended in liquid form in the air shall again be deposited at the separator before it might evaporate into the flow of air. The saturated air is withdrawn at relative negative pressure from the separator and then is compressed by the compressor to a pressure slightly above atmospheric.

The air temperature at the outlet of the heater is regulated to be between 100 and 500° C., and the temperature of the moist air is kept between 50 and 90° C. by appropriately regulating the quantity of air withdrawn from the circuit at 34 and the fresh air introduced at 33.

The configuration shown in FIG. 1 is only one of several feasible ones. In particular, the suction portion of the cylinder and the hot-air supply header may be located at the upper cylinder portion.

In the latter case, the single permeable dewatering fabric between the forming stage and the compression against the Yankee cylinder shall follow another path than that shown. However, this configuration will not at all affect the principle of this embodiment.

The scope of the invention also covers several, and at least two, closed circuits for the dewatering air allowing consecutive dewatering zones, where each circuit comprises a feed box, a return header having a suction slot, a compression means and a heater for the air re-introduced into the supply header. The purpose of such a design is to make possible regulation of the thermodynamic states of the air, in particular its wet bulb temperature, by regulating the particular fresh air inlet means at each circuit. As regards the first zone(s) wherein dewatering takes place substantially by withdrawing liquid water up to 20–35%, an air/water separator is provided between the return headers and the compressor.

Figure 2:
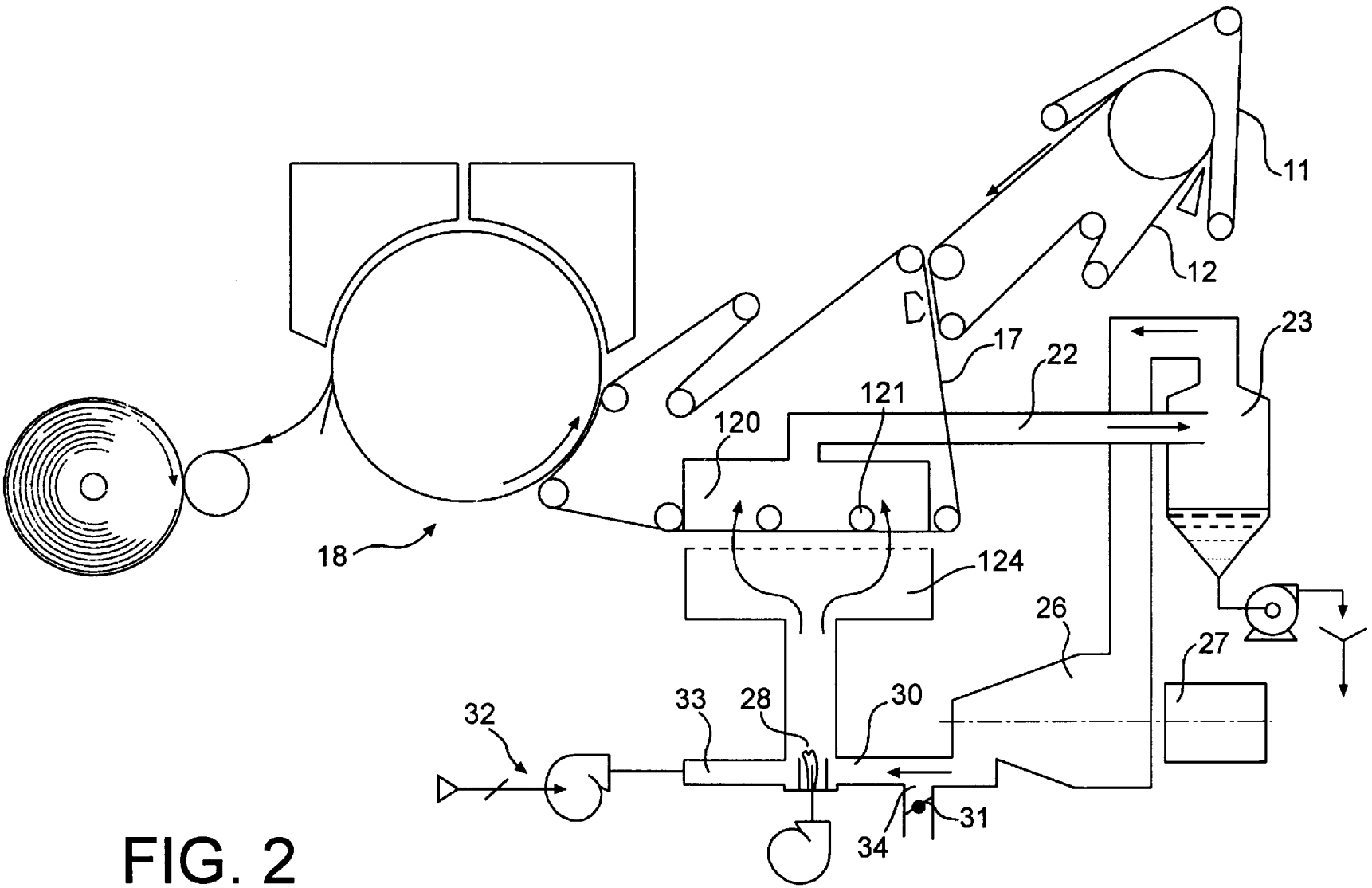
FIG. 2 shows a second embodiment with a stationary suction box.

As regards the second embodiment schematically shown in FIG. 2, wherein the components identical with those of FIG. 1 bear the same references, the dewatering fabric 17, which may be an imprinting type, conveys the moist web through a set of two stationary boxes 120 and 124, namely a suction return header 120 on the side of the dewatering fabric determining the suction surface through which the web is dewatered and a hot-air supply header 124 located on the side of the moist web.

The two boxes are arranged close to one another. The fabric 17 is guided in the gap and thus subtended between the two headers in such a way that the moist web is located on the side of the header feeding the hot air. The fabric itself is held by rollers 121, for example, or else the wire slides on a plate fitted with slots. As in the embodiment of FIG. 1, the air is raised to a speed of 5 to 50 m/sec. on account of the relative negative pressure in the box 124 and consecutively passes through the moist web and the porous fabric from which the air withdraws the desired quantity of moisture.

Again, the configuration shown in FIG. 2 is not unique. Illustratively, the two boxes may be inverted, namely the return header being located under the dewatering fabric which in this variation follows another path than shown without however altering at all the principle of the embodiment. Be it noted that there is only one dewatering fabric between the wet web-forming stage and the drying portion on the drying cylinder.

Figure 3:
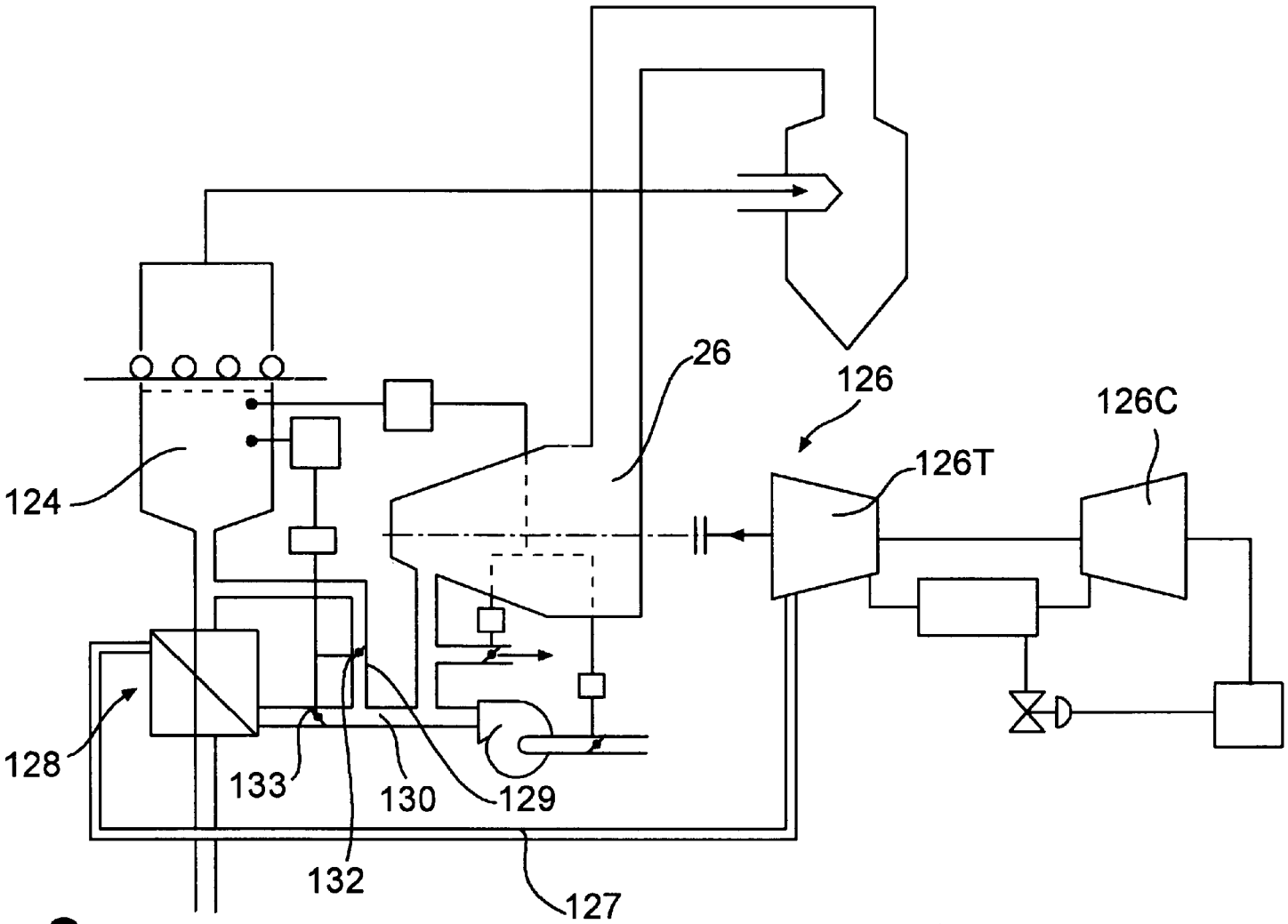
FIG. 3 shows a third embodiment of the invention having total energy.

FIG. 3 shows a total-energy embodiment. As before, those components of the apparatus which are common to the various embodiments bear the same references. In this design, the compressor 26 is driven by a gas turbine assembly 126. In known manner, the assembly comprises a compressor 126C of which the rotor shaft is driven by a turbine 126T actuated by gases from a combustion chamber which itself is fed with combustion air by the compressor. The turbine also drives a shaft coupled to that of the compressor 26. The gases issuing from the turbine are at a sufficiently high temperature, roughly 500° C., to serve as a heat source in the present dewatering apparatus. For that purpose, the heating means for the air from the compressor 26 consists of a heat exchanger 128. This heat exchanger is connected on one side by a conduit 127 to the hot gases from the turbine 126 and on the other side by a conduit 130 to the air output of the compressor 26. An air-tap conduit 129 is provided at the heat exchanger. Two registers 132 and 133 controlled by a regulation circuit for the air temperature inside the air supply header 124 control the effective air flow through he heat exchanger. A standby burner (not shown) may be inserted in the intake conduit of header 124 downstream of the heat exchanger 128. The feed of this standby burner is controlled in cascade with the registers 132, 133 by the same temperature regulator.

The scope of the invention also covers mixing at least part of the exhaust gases of the gas turbine with the compressor air instead of heating the compressor air by means of a heat exchanger.

Figure 4:
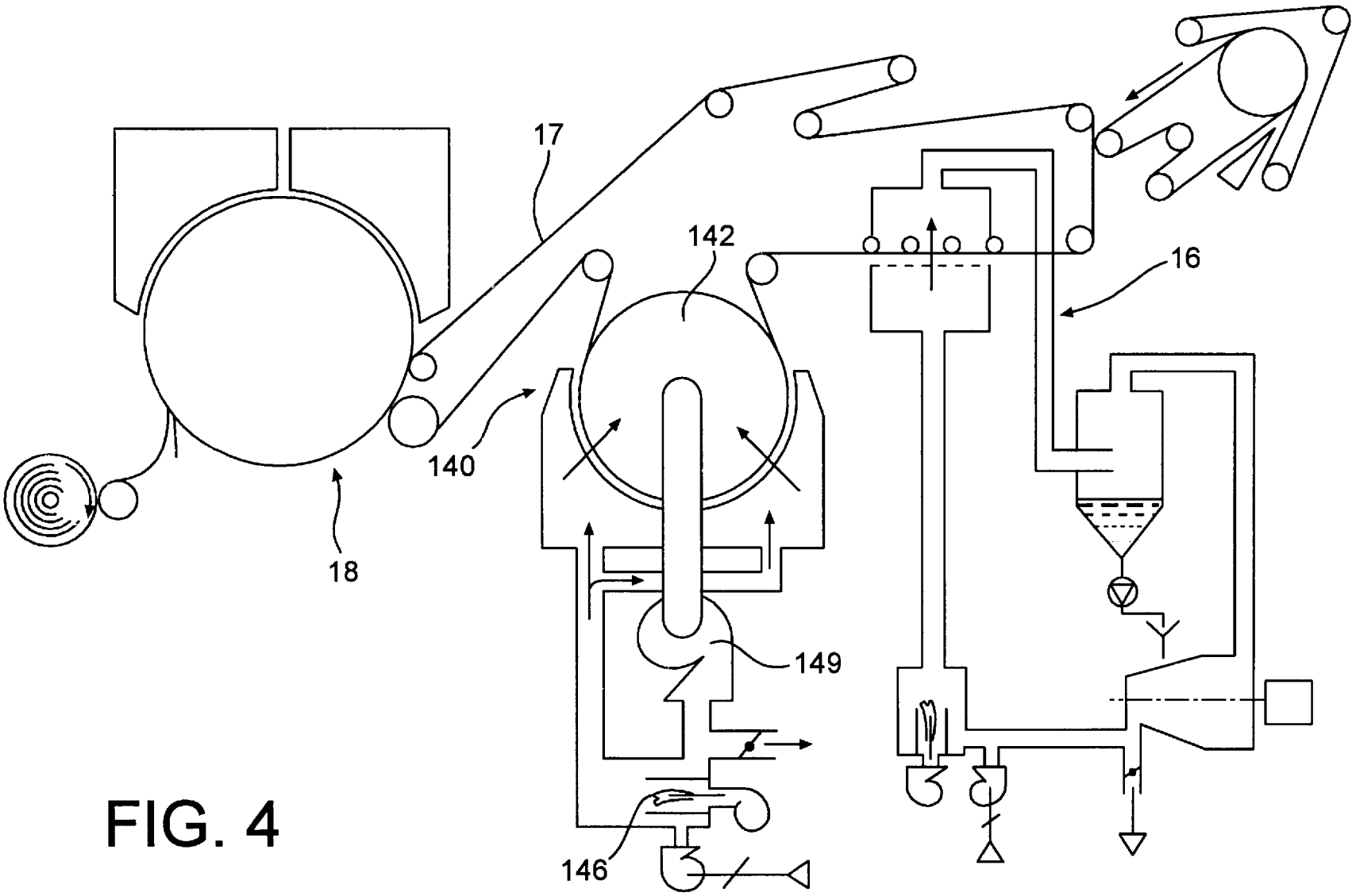
FIG. 4 shows a fourth embodiment of the invention of an assembly of a deep relative negative pressure dewatering means and conventional through-air drying.

FIG. 4 shows a fourth embodiment of the invention showing the path of the moist web between the deep relative negative pressure dewatering apparatus 16 and the Yankee cylinder dryer, and at least one conventional through-air dryer 140 comprising a cylinder 142 rotating on a horizontal shaft. The cylinder's wall is porous and supports the fabric 17. Air heated by a burner 146 is moved by a circulating fan 144 through the moist web pressed against the fabric 17. A burner is provided in known manner in the air-feed circuit to the dryer.

The moist paper web is moved from the forming wire to fabric 17, the web's dryness then being between 8 and 30% approximately. The paper web then undergoes deep relative negative pressure dewatering within the apparatus 16 of the invention and exits apparatus at a solids content between 20 and 45%. Next, the web moves into the dryer 140 wherein it is dried to a solids content as high as 50 to 90%. Then, the paper web is pressed against a Yankee cylinder dryer 18 where it is dried to a solids content of about 95%. The dried web is detached from the cylinder using a creping blade in a manner as known in crepe-paper manufacture.

Be it noted that the schematic of FIG. 4 is a functional diagram which omits some components required for practical operation, for example, additional systems or conveying fabrics.

Again, the scope of the invention also covers the combination of the deep relative negative pressure dewatering of the invention with drying exclusively in the conventional through-air manner.

Experiments were run on a prototype machine to demonstrate the effect of various parameters on the efficiency of dewatering and drying.

I. EFFECT OF INITIAL SOLIDS CONTENT

The method of the invention was tested on a commercial paper towel web made of wadding or creped tissue paper such as marketed as O'KAY. The web was moistened by atomizing dosed amounts of water.

The prototype machine comprises a support plane fitted with a relative negative pressure slot and supporting an air-permeable displaceable grille. The grille speed can be regulated at a predetermined magnitude. A heatable, air-fed nozzle is mounted about the grille in the vicinity of the relative negative pressure slot. The slot communicates with a relative negative pressure source regulated at 250 mbars.

Four test runs were carried out by varying the initial web solids content. In these four runs, the temperature of the air issuing from the nozzle was kept constant as well as the drying time of the samples (by regulating the grille's speed above the relative negative pressure slot).

The following test values were obtained:

| Test Run No. | 1 | 2 | 3 | 4 |
|---|---|---|---|---|
| Air temperature (° C.) | ambient | 150 | 150 | 150 |
| Drying time (sec.) | 9/100 | 4.5/100 | 6/100 | 9/100 |

Figure 5:
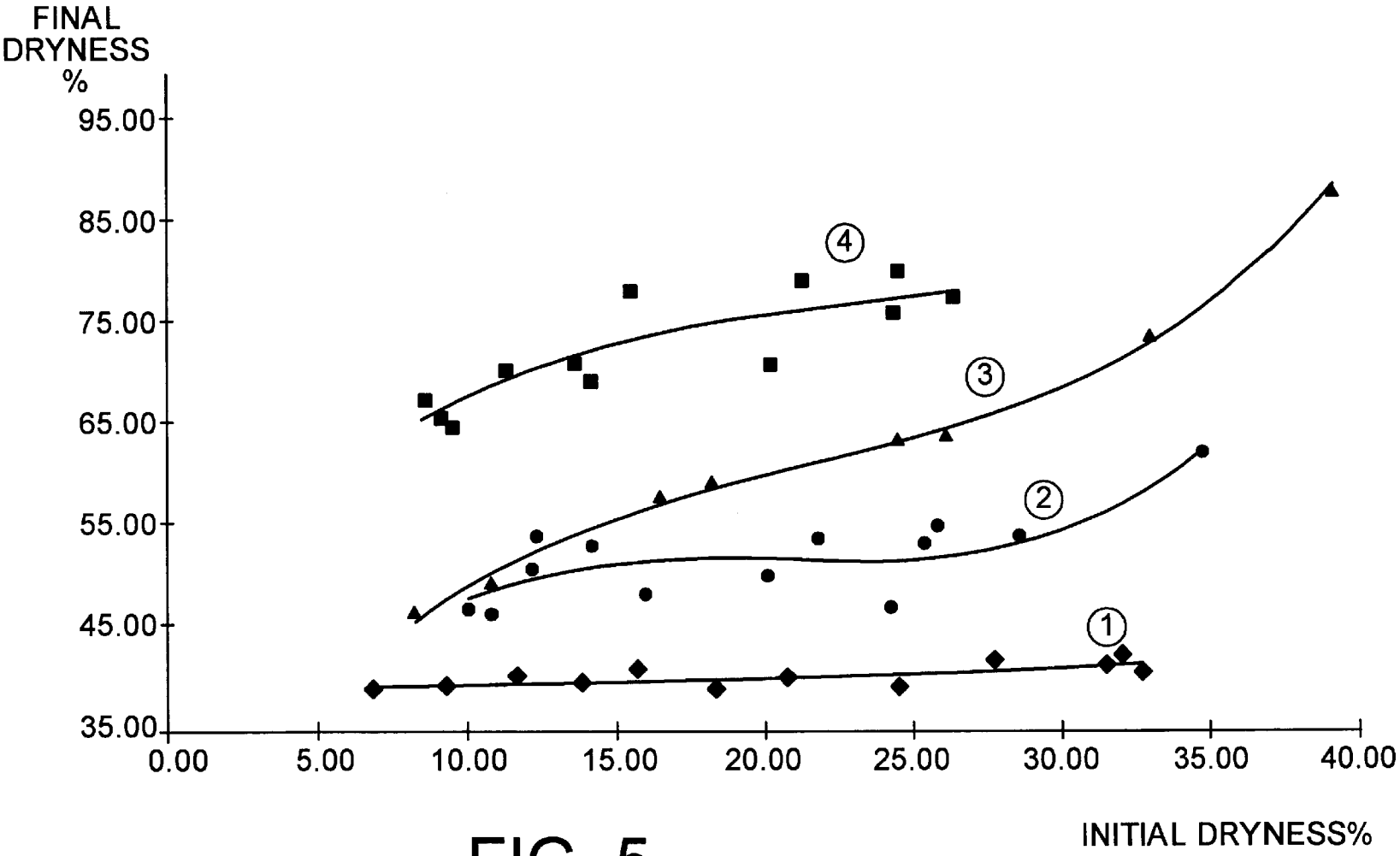
FIGS. 5–8 are plots summarizing tests run on prototype machines.

Several values of initial solids content and the values of the final solids content of the samples are plotted in FIG. 5.

It is clear from curve (1) that when the air is at ambient temperature, the final solids content will be 45% or less regardless of the initial solids content. At a constant drying time of 9/100 sec., the hot air provides reaching a solids content between 65 and 75% as shown by curve (4).

II. EFFECT OF DRYING TIME

Two new test runs were carried out on samples of tissue paper having a specific surface weight of 17.6 g/m$^2$ and the same initial solids content. The relative negative pressure source was regulated at 340 mbars.

As regards the first test run 1, the air of the feed nozzle was at ambient conditions (20° C. and 5 g of water vapor per kg of dry air).

As regards the second test run 2, the air was preheated to 200° C. and was substantially moistened. The wet bulb temperature was 64° C. (120 g of water vapor per kg of dry air).

Figure 6:
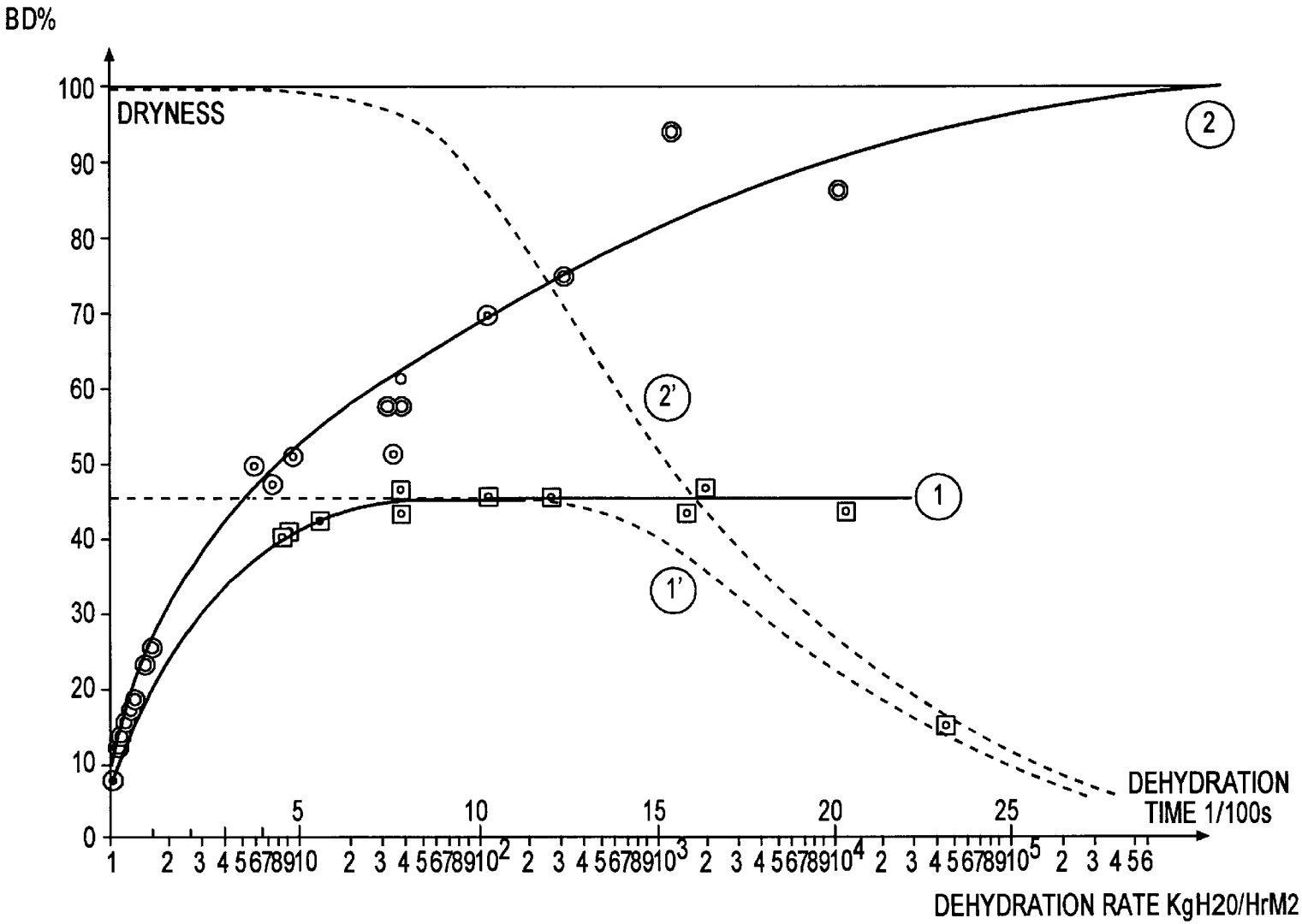

The solids content reached by the samples as their drying time increased was measured. FIG. 6 shows the resultant plot. It is seen that at ambient temperature, i.e., for curve (1), it is impossible to exceed a solids content of 40–45% even for an extended time period. On the other hand, curve (2), representing hot moist air, rapidly exceeds the magnitude. It is further shown that the dewatering rate is always higher, this feature very clearly shown by the curves (1') and 2') respectively, showing logarithmically the dewatering rate in kg of water withdrawn per hour and per m$^2$ in relation to the solids content of the web.

By comparison, conventional through-air drying has the following characteristics:

| Wire Speed | 760 m/min |
|---|---|
| Dry air temperature (° C.) | 200° C. |
| 3.60 m diameter cylinder, open over | 270° |

and results in a web solids content of 65% in 67/100 sec. Accordingly, the drying time of the dryer of the invention is 7 to 8 times shorter for a relative negative pressure 5 to 10 times deeper.

III. EFFECT OF THE QUANTITY OF MOISTURE IN THE CROSSING AIR ON THE DRYING ABILITY OF A VERY MOIST WEB

Tests were run on a prototype machine of a slight width and comprising a forming stage having a forming wire, a transfer means to an imprinting fabric, a by-passable through-air drying section and a Yankee-type drying cylinder with a transfer press. To meet the requirements of these tests, a dewatering/drying assembly of the invention was placed in the vicinity of the imprinting fabric. Schematically, the overall apparatus is that diagrammatically shown in FIG. 4.

Three tests were carried out. The operational parameters were the following:

| | Test Run 1 | Test Run 2 | Test Run 3 |
|---|---|---|---|
| Web spec. surface wt. (g/m$^2$) | 21 | 22 | 22 |
| Relative negative pressure (mbars) | 350/400 | 350/400 | 350/400 |
| Air flow (kg/m$^2$/s) | 19/20 | 19/20 | 19/20 |
| Dry bulb air temperature (° C.) | ambient | 180/200 | 180/200 |
| Wet bulb air temperature (° C.) | | | |
| Blow side | 13 | 65 | 70 |
| Suction side | 13 | 52 | 56 |

Figure 7:
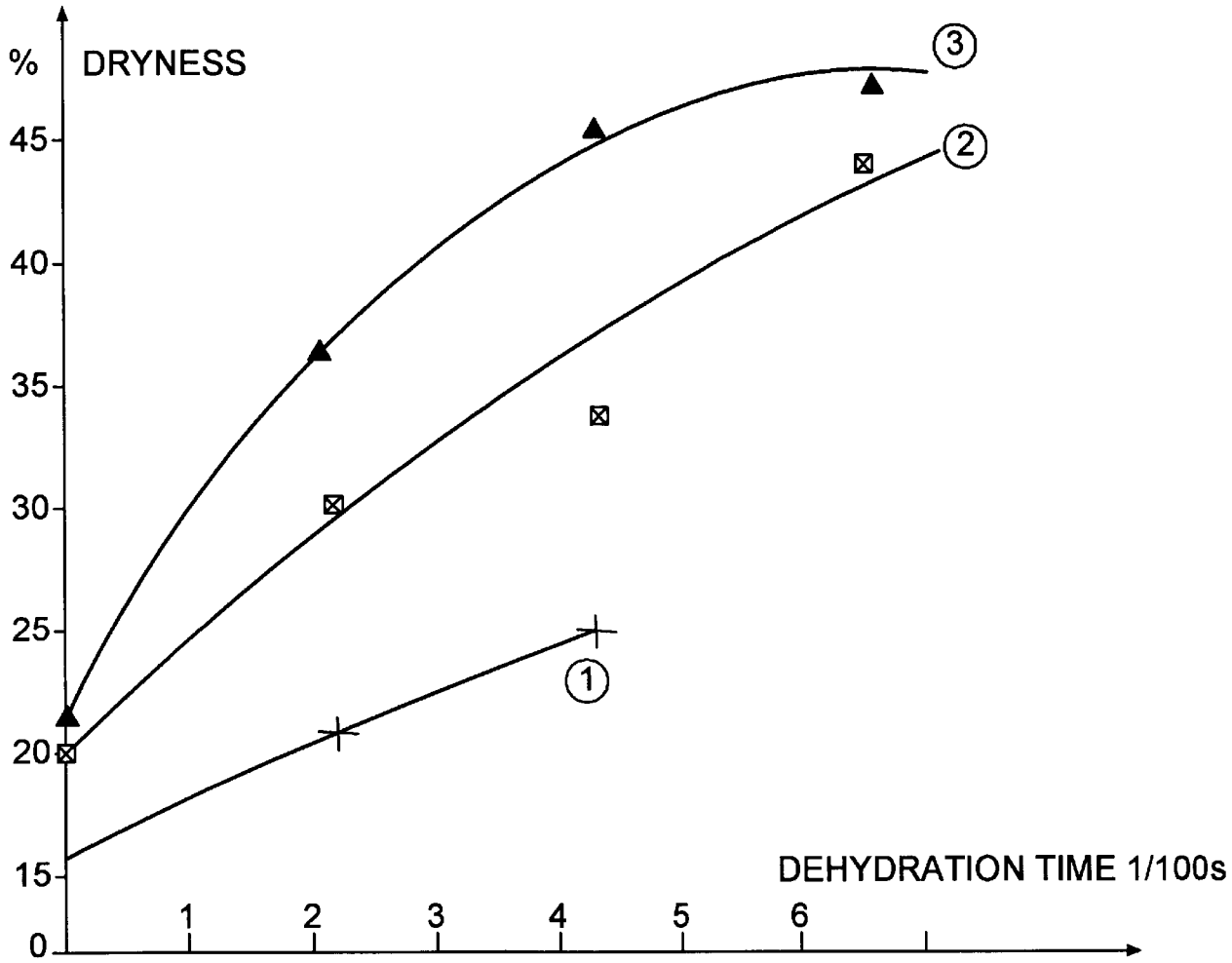

The web solids content for various drying times were logged in ortho-normalized manner. After smoothing the test results, the curves (1), (2) and (3) of FIG. 7 were obtained which correspond to Test runs 1, 2, and 3.

It will be observed that the dewatering rate, which is given by the slope of the curves, when in the interval of 15 to 35% solids wherein the dewatering takes place substantially by carrying away the liquid water, increases with the quantity of vapor in the air.

The average dewatering rate within the interval when expressed in kg water withdrawn per hour and per m$^2$ was found to be:

| | Test Run 1 | Test Run 2 | Test Run 3 |
|---|---|---|---|
| Dewatering rate (kg/hr/m$^2$) | 3980 | 6100 | 7600 |

IV. EFFECT OF METHOD OF INVENTION ON WEB BULK

Tissue paper tests were carried out on the above prototype papermaking machine using an imprinting fabric. In these tests, the manufactured products substantially evinced the same specific surface weight and the same fiber composition. They were all dried and creped on the Yankee at the same solids content 95%. The solids content was measured at the Yankee entry and also the web bulk (cm$^3$/g) following creping.

First test run 1: Without heating the air, the dewatering apparatus was used as a conventional box associated with an imprinting fabric through-air dryer.

Second test run 2: Only the dewatering apparatus of the invention was used while adjusting the time and moisture parameters in such a way that the web evinced a 50% solids content at the Yankee entry.

Third test run 3: The dewatering of the invention was combined with a negative pressure box fed with hot and moist air and with drying by conventional through-air drying.

Figure 8:
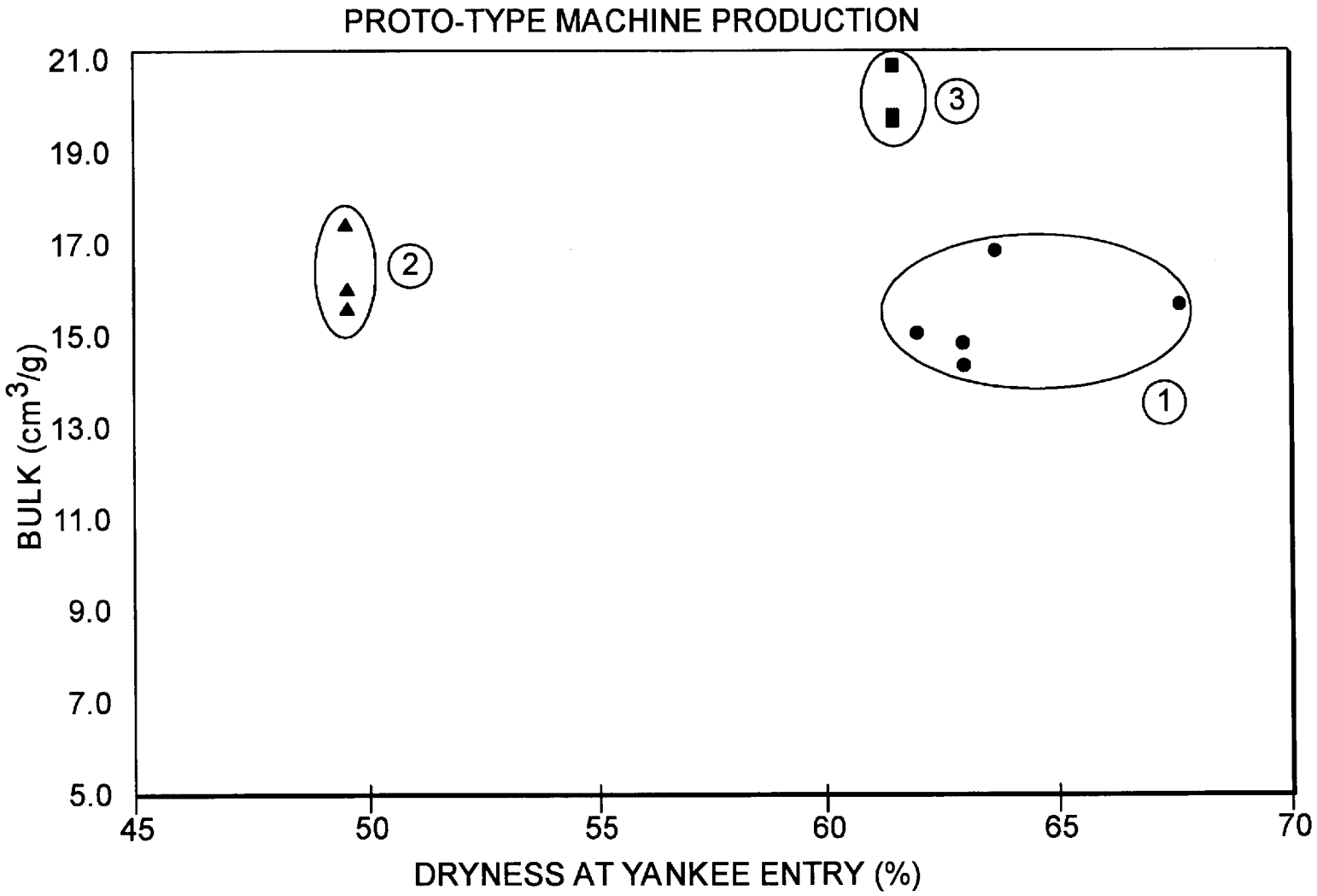

FIG. 8 is a plot of the web bulk magnitude resulting from the three test runs 1, 2, and 3. Three clusters of corresponding points are obtained, namely (1), (2), and (3).

It is noted that the resulting bulk is between 15 and 17 cm$^3$/g when drying the web solely in the manner of the invention 2, merely to a solids content of 50%. As regards the conventional through-air drying procedure 1, drying is required as high as to 60–65%.

The combination of the two procedures 3 shows substantial bulk increase of the web to 19 to 21 cm$^3$/g.

Without being bound to any theory, the method of the invention allows improved fiber shaping to the geometry of the imprinting fabric because the fibers are hotter and hence more flexible than in a prior art relative negative pressure box in which the air is at ambient temperature. Moreover, following their shaping, the fibers are dried more abruptly by the deep relative negative pressure. In this manner, the structure is stabilized earlier at a lower average moisture. Therefore, the web can be bonded earlier to the wall of the Yankee drying cylinder at a lower solids content than is the case in a conventional through-air procedure while the same bulk is present.

Figure 9:
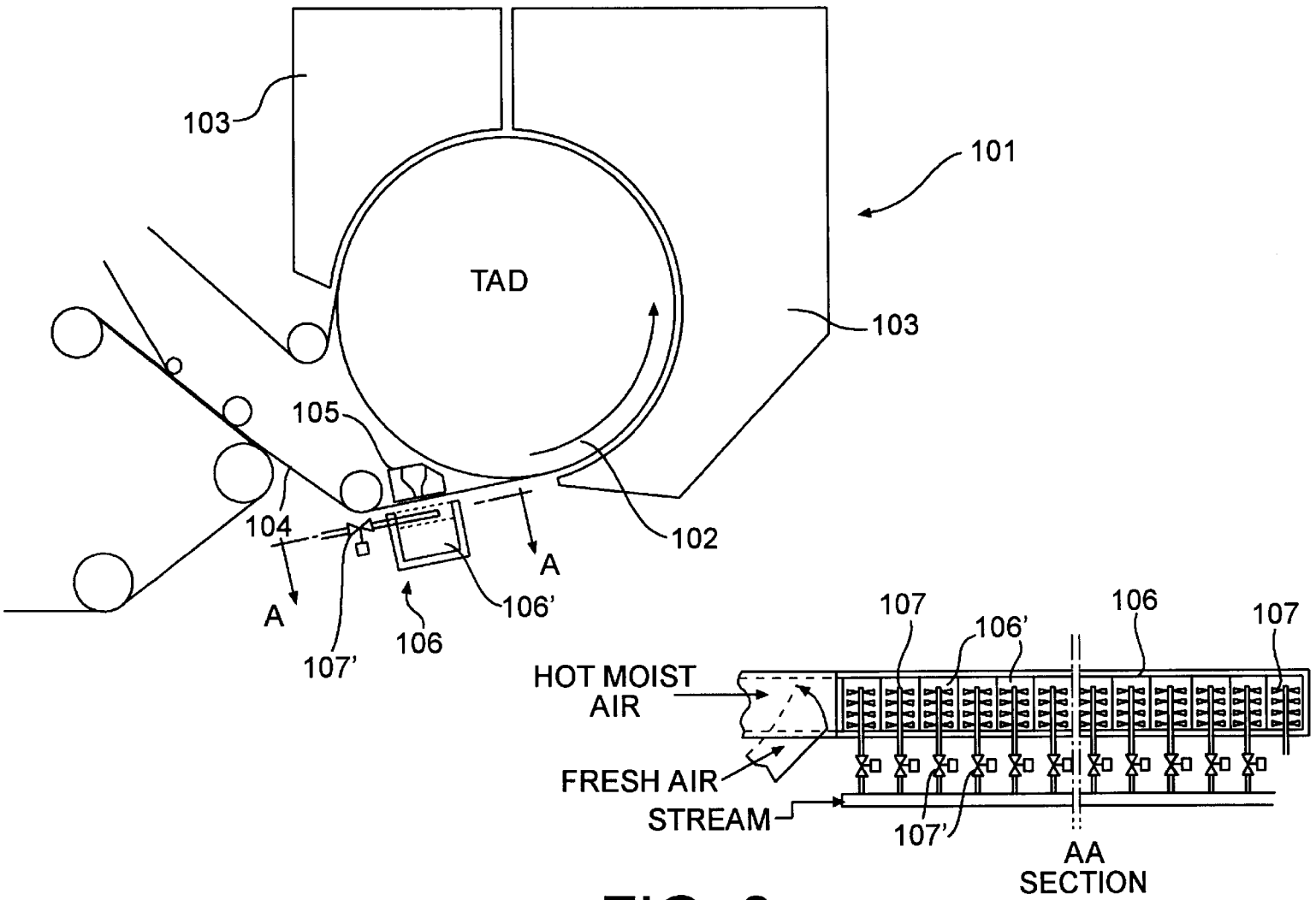
FIG. 9 shows a fifth embodiment of the invention including steam injection to correct the moisture profile of the web.

Another embodiment of the invention is described below in relation to FIG. 9. This Figure shows the drying stage of a papermaking machine incorporating a conventional through-air dryer 101 having a rotary cylinder with a porous wall 102 and air blowing hoods 103. An illustrative imprinting fabric 104 holds the web issuing from the forming stage and is driven through the dryer and around the cylinder 102.

In the invention, a return header 105 of which the suction slot opens on the side of the fabric 104 opposite the web is mounted upstream of the cylinder 102. The box 105 communicates with a deep relative negative pressure source of 100 to 500 mbars. Contrary to the design of the prior art wherein the slot pulls in the ambient air, the present return header communicates on the suction side with a hot-air supply header. The dry bulb air temperature is between 100 and 500° C. The wet bulb air temperature is between 50 and 90° C.

In a novel feature of the invention, the moisture of this air is modulated in the transverse direction. As shown above, the efficiency of dehydrating water in liquid form by the apparatus of the invention rises as the moisture moved by the hot crossing air rises. This property is utilized to transversely modulate the profile of the residual moisture of the web.

For that purpose, as shown in FIG. 10, header 106 has been divided into a large number of contiguous sub-headers 106' by means of partitions transverse to header 106 and arranged at regular spacings. A preferably superheated steam injection bank 107 is mounted inside each sub-header 106'. Each battery is supplied with steam from a collector through a valve 107' of which the aperture is controlled as a function of the predetermined value depending on the desired solids content of the particular web zone. By measuring web solids content at each of the zones downstream of the dryer or downstream of the Yankee cylinder which follows the dryer, and by commensurately controlling each valve 107', the solids content profile of the web at the exit of the dryer or at the exit of the Yankee cylinder following the dryer can be corrected.

We claim:

1. A method for dehydrating or dewatering a moist cellulose web having a dry specific surface weight between 10 and 80 g/m$^2$ and an initial solids content of between about 8 and about 30% after draining on a forming wire, said method comprising laying said web on a permeable conveying fabric and traversing the web with at least one high speed flow of air, wherein the flow of air is generated by a relative negative pressure of about 100 to about 500 millibars under the permeable conveying fabric.

2. The method according to claim 1 wherein the air has a dry bulb temperature of between about 100° C. and about 500° C.

3. The method according to claim 1 wherein the air has a wet bulb temperature of between about 50° C. and about 90° C.

4. The method according to claim 1 wherein said flow of air circulates in a closed circuit and after said flow of air has passed through said web, said flow of air is collected by a return header maintained at a relative negative pressure of about 100 to 500 mbars, guided toward and through an air/water droplet separator in order to eliminate water suspended in said air, compressed to a pressure higher than atmospheric, heated to a temperature between about 100° C. and about 500° C., and guided by a supply header toward the surface of the web laying on the conveying fabric.

5. The method according to claim 4 wherein a portion of the air which is compressed is exhausted and a corresponding amount of air is introduced into the closed circuit in order to maintain air which enters said supply header at a wet bulb temperature of between about 50° C. and about 90° C.

6. The method according to claim 1 wherein said at least one high speed flow of air comprises a first air flow and a second air flow wherein the second air flow is hot air which traverses the web downstream of the first air flow, and the second air flow has a wet bulb temperature which is different from the wet bulb temperature of the first air flow.

7. The method according to claim 1 wherein said high speed flow of air dries said web up to a solids content of between about 35 and about 75%, and wherein the web is then further dried using a Yankee-type cylinder up to a solids content of about 95%.

8. The method according to claim 1 wherein said high speed flow of air dries said web up to a solids content of between about 35 and about 75%, the conveying fabric is an imprinting type conveying fabric, and, thereafter, the web is further dried on a Yankee-type cylinder to a solids content of about 95%.

9. The method according to claim 1 wherein said high speed flow of air dries said web up to a solids content of between about 20 and about 45%, the permeable conveying fabric is an imprinting-type fabric, and thereafter, drying is further carried out on said permeable fabric by at least one through air-type dryer until a solids content of between about 50 and 90% is obtained in the web and, thereafter, drying is further carried out on a Yankee-type cylinder including a creping blade up to a solids content of about 95%.

10. The method according to claim 1 wherein said high speed flow of air dries said web to a solids content of between about 20 and about 45%, the permeable conveying fabric is an imprinting type fabric, and, thereafter, further drying is carried out on said permeable fabric using at least one through air-type dryer until the web has a solids content of about 95%.

11. The method according to either claim 4, 9 or 10 wherein at least a portion of the air supplied is withdrawn from said through-air dryer.

12.The method according to either claim 9 or 10 wherein at least a portion of the air supplied is withdrawn from drying hoods present in relation to a Yankee-type cylinder dryer.

13. The method according to claim 6 wherein dosed quantities of steam are injected into the hot air before the hot air crosses the web, said dosed quantities of steam being modulated in a cross direction to the web travel direction in order to vary moisture content of the hot air.

14. Apparatus for dehydrating a moist cellulose web comprising a moving permeable conveying fabric with one side for supporting a web to be dehydrated;

an air supply header having an air intake ducting and a feed aperture facing said one side of the permeable conveying fabric;

a heater adapted for heating air introduced into the air intake ducting;

a return header for collecting air coming from the supply header and located to face the opposite side of the permeable conveying fabric and having at least one suction slot facing the feed aperture of the supply header; and a means for keeping the return header at a relative negative pressure of about 100 to about 500 mbars.

15. Apparatus as claimed in claim 14 further comprising:

an air/water separator pneumatically connected to the return header;

an air compressor pneumatically connected to the air/water separator;

an air heater pneumatically connected to the air compressor;

a ducting connecting the air heater to the supply header;

a means for exhausting air from the compressor; and a means for introducing air pneumatically connected with the heater.

16. Apparatus as claimed in claim 15 further comprising a gas turbine assembly which drives said compressor, and wherein the air heater includes a heat exchanger which is connected on a first side with exhaust gases from said gas turbine assembly and with the air flowing out of said compressor on the other side.

17. Apparatus as claimed in claim 14 further comprising at least two circuits for air dehydrating, each circuit having associated supply headers, respectively located one after another in the machine direction, and wherein at least a first circuit feeds a first zone in the machine direction including an air/water separator.

18. Apparatus as claimed in claim 17 further comprising steam injection means mounted inside at least the first of the associated supply headers in the machine direction.

19. Apparatus as claimed in claim 18 wherein said supply headers are divided into a plurality of sub-headers arranged in the cross machine direction, at least one of the sub-headers including a steam injection means.

20. The method according to claim 6, wherein the wet bulb temperature of said second air flow is lower than the wet bulb temperature of the first air flow.

21. The method according to claim 7, wherein said web is traversed by at least two high speed flows of air and wherein the second high speed flow of air does not include an air/water droplet separator.

* * * * *

UNITED STATES PATENT AND TRADEMARK OFFICE

CERTIFICATE OF CORRECTION

PATENT NO.: 5,974,691

DATED: November 2, 1999

INVENTORS: Marchal et al.

It is certified that an error appears in the above-identified patent and that said Letters Patent is hereby corrected as shown below:

Claim 4, Col. 11, L. 16 CHANGE "laying" TO --lying--.

Signed and Sealed this

Second Day of January, 2001

*Attest:*

*Attesting Officer*

Q. TODD DICKINSON

*Commissioner of Patents and Trademarks*